US011766098B2

(12) United States Patent
François et al.

(10) Patent No.: US 11,766,098 B2
(45) Date of Patent: Sep. 26, 2023

(54) FASHION ITEM INCLUDING A THIN WALL WITH LOCALLY AND SELECTIVELY EXPANDABLE AREAS

(71) Applicant: The Swatch Group Research and Development Ltd, Marin (CH)

(72) Inventors: Nicolas François, Neuchatel (CH); Sophie Napoli, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 64 days.

(21) Appl. No.: 17/526,730

(22) Filed: Nov. 15, 2021

(65) Prior Publication Data

US 2022/0240633 A1 Aug. 4, 2022

(30) Foreign Application Priority Data

Feb. 4, 2021 (EP) ..... 21155224

(51) Int. Cl.
*A44C 5/02* (2006.01)
*A44C 15/00* (2006.01)
*A44C 5/00* (2006.01)

(52) U.S. Cl.
CPC ..... *A44C 5/0053* (2013.01); *A44C 5/0007* (2013.01)

(58) Field of Classification Search
CPC ... A44C 5/0053; A44C 5/0007; A44C 5/0069; A44C 5/0015; A44C 5/00
USPC ..... 40/800
See application file for complete search history.

(56) References Cited

U.S. PATENT DOCUMENTS 3,369,722 A * 2/1968 Hetterich ..... A44C 5/0053 224/178
4,357,694 A * 11/1982 Montuori ..... A44C 5/0092 428/595
5,425,228 A * 6/1995 Hillel ..... A44C 11/00 59/80
5,908,302 A * 6/1999 Goldfarb ..... G09B 23/285 40/446

(Continued)

FOREIGN PATENT DOCUMENTS

CH 711 917 A2 6/2017
DE 41 35 235 A1 6/1992

(Continued)

OTHER PUBLICATIONS

European Search Report for EP 21 15 5224 dated Jul. 14, 2021.

*Primary Examiner* — Jack W Lavinder
(74) *Attorney, Agent, or Firm* — Sughrue Mion, PLLC

(57) ABSTRACT

A fashion item (100) including a thin wall with locally and selectively expandable areas including: an internal core (30) made of a lining material which can expand in contact with a liquid; a support layer (10) having an external face (11) opposite an internal face (12) on which the internal core (30) is arranged, the support layer (10) being configured so that the expansion of the lining material does not substantially cause its deformation; and an impermeable covering layer (20) attached to the support layer (10) so as to tightly enclose the internal core (30), the layer including one or a plurality of through holes (21) opening onto the internal core (30) and arranged relative to each other so as to form a predefined matrix, the covering layer (20) being configured such that the expansion of the lining material substantially causes its deformation.

12 Claims, 1 Drawing Sheet

(56) References Cited

U.S. PATENT DOCUMENTS

2007/0062041 A1* 3/2007 Cerato ..... B23K 1/0008
29/896.43

FOREIGN PATENT DOCUMENTS

EP 1 852 249 A1 11/2007
WO 2006/057199 A1 6/2006

* cited by examiner

A-A

B-B

FASHION ITEM INCLUDING A THIN WALL WITH LOCALLY AND SELECTIVELY EXPANDABLE AREAS

CROSS REFERENCE TO RELATED APPLICATION

This application is Non-Provisional Application, claiming priority on European Patent Application 21155224.5 filed Feb. 4, 2021.

TECHNICAL FIELD OF THE INVENTION

The invention falls within the field of fashion items including a thin wall, in particular strip-shaped items that can be worn by a user, for example the field of bracelets in particular intended to be attached to a watch or to a piece of jewellery, the field of straps, necklaces, etc.

More particularly, the invention relates to a fashion item including a thin wall with locally and selectively expandable areas.

In the present text, the fashion item according to the invention is described in one of its preferred applications wherein it is in the shape of a strip, in particular of a bracelet intended to be worn on the wrist of a user.

TECHNOLOGICAL BACKGROUND

In general, the structure and the materials used for the production of fashion items including a flexible thin wall, in particular those in the shape of a strip, depend on the desired aesthetics and on the function and/or use for which said fashion items are intended.

More particularly, in the field of watchmaking or in the field of jewellery, there are bracelets made entirely or partially of leather, woven textile fibres, polymers, such as rubber, or metallic material, such as steel, titanium or gold.

For example, materials such as textile fibres and polymers are intended for use with the bracelet rather for sports activities, metallic materials are reserved for use underwater or in a humid environment.

Moreover, the bracelets can have decorative elements on their outer surface, the shape of which depends on the material of said bracelets. For example, the decorative elements may be in the shape of a combination of materials, of a particular colouring or finish of the coating of the outer surface of the bracelet, of reliefs resulting from the machining or moulding of the material constituting the bracelet, etc.

The production of a decoration on a bracelet depends on a dedicated manufacturing process implementing specific manufacturing means, suitable for each decoration. For example, a decoration can be produced with the use of a specific tool, such as a press including a die suitable for making specific impressions on the fashion item, or an injection press adapted for overmoulding a decorative layer on a base layer according to a mould of given shape.

Changing a decoration therefore involves changing its manufacturing process, and often changing the tool attached thereto.

A user therefore has the leisure of being able to choose a bracelet having a decoration from a choice of decorations belonging to a range which is offered to them on the market, but the decoration of this bracelet is neither customised nor customisable, taking into account the aforementioned drawbacks resulting from the change of the decorations of the bracelets.

There is therefore a need to have a bracelet whose decoration can be customised according to the wishes of a user, in a simple, fast and low-cost manner.

The terms "simple and fast" mean here that the customisation of the decoration of a bracelet does not involve changing the processes or the production means of this bracelet.

The aforementioned drawbacks are found regardless of the shape taken by the fashion item of the prior art, for example the shape of a strap, a necklace, a bag, a clothing, etc.

SUMMARY OF THE INVENTION

The invention overcomes the aforementioned drawbacks by providing a fashion item whose structure allows the production of a specific decoration, according to the wishes of a user. In other words, it is possible to propose on the basis of fashion items meeting the same features, that is to say the features of the present invention, different decoration patterns of said fashion items without modifying their manufacturing process, nor the corresponding production means.

To this end, the present invention relates to a fashion item including a thin wall, preferably flexible, with locally and selectively expandable areas, said thin wall comprising:

- an internal core made of a lining material which can expand in contact with a liquid, for example in contact with water,
- a support layer comprising an external face opposite an internal face on which the internal core is arranged, said support layer being configured so that the expansion of the lining material does not substantially cause its deformation,
- an impermeable covering layer attached to the support layer so as to tightly enclose the internal core, said layer including one or a plurality of through holes opening onto the internal core and arranged relative to each other so as to form a predefined matrix, said covering layer being configured such that the expansion of the lining material substantially causes its deformation.

When the fashion item is contacted with a liquid, the latter penetrates into the holes until it contacts the internal core and locally causes the expansion of the lining material and thus the deformation of the covering layer.

This deformation of the covering layer generates a relief on a visible face of the fashion item, the shape of this relief being able to be selected so as to correspond to any desired graphic representation according to the matrix defined by the set of holes.

Thanks to these features, it is possible to obtain a fashion item including a thin wall of material with locally and selectively expandable areas, the aesthetic appearance of which can be specific so as to correspond to a particular wish of a user for example, without changing the manufacturing process or manufacturing tools of said fashion item.

Advantageously, the holes can be made at the last moment before the sale of the fashion item and according to a matrix selected for example by the end customer.

In particular embodiments, the invention may further include one or more of the following features, taken in isolation or in any technically possible combination.

In particular embodiments, the lining material is composed of a hydrophilic thermoplastic elastomer material, super-absorbent fibres, and a compatibilising agent.

In particular embodiments, the lining material is composed of a polyurethane having a hardness approximately equal to 40 shore A, from 5% to 45% by weight of super-absorbent fibres, and a compatibilising agent.

Advantageously, the lining material can be selected so that it returns to its initial state, that is to say the state it occupied before its expansion, when it is no longer in contact with a liquid.

In particular embodiments, the support layer includes a bottom wall interconnecting two side walls, said bottom walls and side walls forming a groove wherein the internal core rests.

In particular embodiments, the support layer is made of a material having an elastic modulus greater than 10 MPa and an elongation at break less than or equal to 180%.

In particular embodiments, the support layer is overmoulded to the internal core.

In particular embodiments, the covering layer is produced by a laminated complex composed of an elastic flexible membrane having an elongation at break greater than 600% and a modulus of elasticity less than or equal to 20 MPa measured at 600% elongation and a stretched polytetrafluoroethylene membrane.

In particular embodiments, the covering layer is configured to cover the internal core by overmoulding or by embossing.

In particular embodiments, the through holes are produced by micro-perforations, in particular by laser machining.

In particular embodiments, the fashion item is formed of a strap, a garment, a bag or any other flexible or non-flexible container, a bracelet or a necklace.

According to another object, the present invention relates to a bracelet comprising at least one strand including the features of a fashion item as described above.

Another aspect of the invention relates to a method for manufacturing a fashion item including a thin, flexible wall with locally and selectively expandable areas as described above, said method comprising:

- a first attachment step wherein the covering layer and the internal core are connected to each other,
- a second attachment step wherein the support layer is connected to the assembly obtained in the first attachment step so that the support layer and the covering layer tightly enclose the internal core.

Yet another aspect of the invention relates to a method for manufacturing a fashion item including a thin, flexible wall with locally and selectively expandable areas, as previously described, said method comprising:

- a first attachment step wherein the support layer and the internal core are connected to each other,
- a second attachment step wherein the covering layer is connected to the assembly obtained in the first attachment step so that the support layer and the covering layer tightly enclose the internal core.

BRIEF DESCRIPTION OF THE FIGURES

Other features and advantages of the invention will become apparent upon reading the following detailed description given by way of non-limiting example, with reference to the appended drawings wherein.

DETAILED DESCRIPTION OF THE INVENTION

Figure 1:
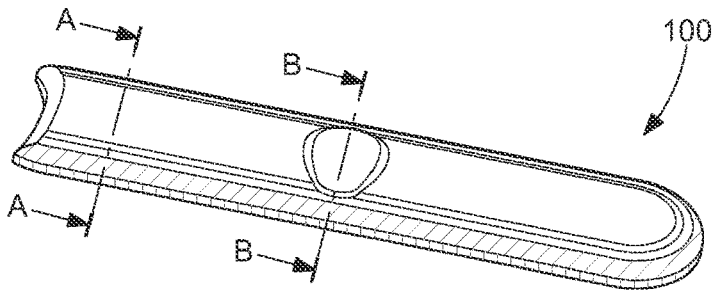
FIG. 1 schematically shows a perspective view of part of a bracelet according to a preferred exemplary embodiment of the invention.

FIG. 1 shows a schematic perspective representation of a preferred exemplary embodiment of a fashion item 100 including a thin wall, preferably flexible, locally and selectively expandable areas according to the invention, wherein said fashion item 100 is in the shape of a watch bracelet.

It should be noted here that the fashion item 100 with locally and selectively expandable areas can advantageously be used in other applications without this leading to a change in its technical features. By way of non-limiting example, it can be in the shape of a strap, a bag, a necklace, a garment, or any other fashion item comprising a thin, preferably flexible wall.

FIG. 1 illustrates a strand of a bracelet according to a preferred exemplary embodiment of the present invention comprising a support layer 10 to which a covering layer 20 is hermetically connected so as to tightly enclose an internal core 30 made of a lining material.

The term "connected" means in the present description "attached", so as to prohibit any degree of relative mobility between the elements concerned.

Advantageously, the lining material is expandable in contact with a liquid.

For example, the lining material can be a thermoplastic elastomer material.

In a preferred exemplary embodiment of the invention, the lining material is composed of a hydrophilic thermoplastic polyurethane preferably having a hardness substantially equal to 40 shore A, from 5% to 45% by weight, for example 20%, of super-absorbent fibres known as such to the person skilled in the art, and 2% by weight of a compatibilising agent, for example polyethylene glycol.

The internal core 30 can either be obtained directly by moulding, or be cut from previously manufactured plates or strips of lining material.

Figure 2:
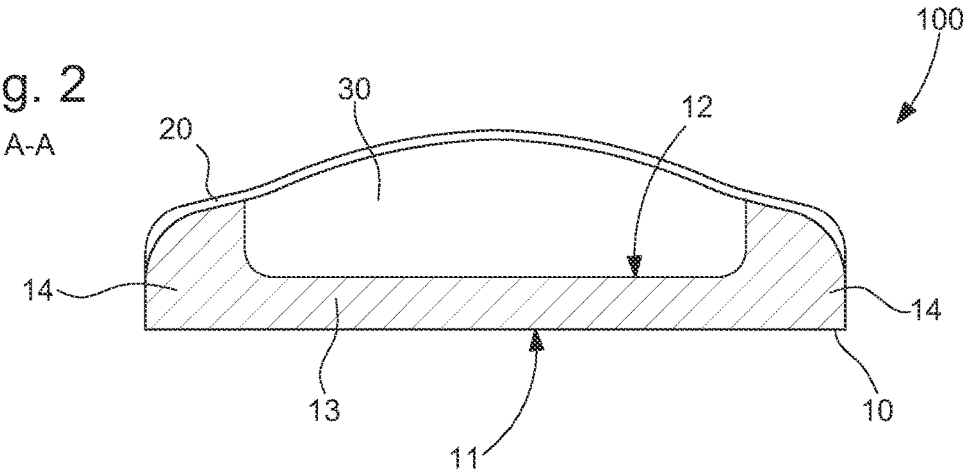
FIG. 2 shows a cross-sectional view along the sectional axis A-A of FIG. 1.
Figure 3:
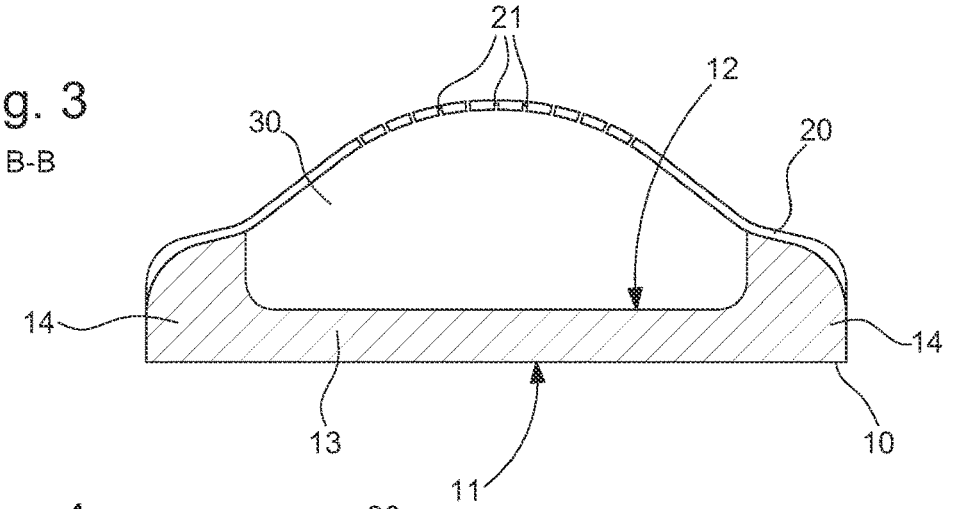
FIG. 3 shows a cross-sectional view along the sectional axis B-B of FIG. 1

As shown in the sectional views of FIGS. 2 and 3, the support layer 10 comprises an outer face 11 which, in the example of application of the invention shown in said figures, is intended to be oriented towards the wrist of a user when the bracelet is worn by said user, and an internal face 12 against which the internal core 30 is arranged.

More particularly, in the preferred exemplary embodiment of the present invention shown in FIGS. 1 to 3, the support layer 10 includes a bottom wall 13 interconnecting two side walls 14. The side walls 14 extend in the same direction and in a direction substantially perpendicular to the direction in which the bottom wall 13 extends. It should be noted that the side walls 14 can be formed by any bulge, projection or protrusion extending from the bottom wall 13.

Thus, as shown in FIGS. 2 and 3, the bottom wall 13, in combination with each of the side walls 14, forms a groove receiving the internal core 30. More specifically, the internal core 30 is dimensioned so as to rest against the internal face 12 of the bottom wall 13, and each of the side walls 14.

For reasons of ease of manufacture and mechanical strength, a fillet may be formed between the internal face 12 of the bottom wall 13 and each of the side walls 14.

Preferably, the support layer 10 is intended to constitute the framework of the fashion item 100 in the sense that it is intended to give said item its rigidity and its mechanical resistance to stresses.

Advantageously, the support layer 10 is configured so that the expansion of the lining material does not substantially cause the deformation of said support layer 10. In other words, the support layer 10 has such resistance to the pressure forces resulting from the increase in volume of the internal core 30, that it does not deform in a manner which is perceptible to a user.

Preferably, the support layer 10 is made of a material having an elastic modulus greater than 10 MPa measured at 100% elongation and an elongation at break less than or equal to 180%.

Such a material can be a natural or synthetic leather, a textile or an elastomer and can be combined with non-woven textile fibres or any other suitable component in order to increase its mechanical resistance to deformation.

The support layer 10 and the covering layer 20 are connected together so as to tightly enclose the internal core 30.

This covering layer 20 has the particular objective of protecting the internal core 30 from possible attacks from the external environment, such as shocks, impacts or friction, exposure to ultraviolet rays, to humidity, etc., and to contribute to the solution of the problem solved by the invention as described in more detail below, in addition to playing an aesthetic role.

The covering layer 20 is advantageously impermeable and includes one or a plurality of through holes 21 opening on the one hand onto the internal core 30 and on the other hand onto the external environment. The through holes 21 are arranged relative to each other so as to form a predefined matrix. The term "matrix" here means that the plurality of holes form a particular pattern. This pattern can be selected or generated randomly.

These through holes 21 advantageously allow a liquid present in the environment outside the fashion item 100 to penetrate through the covering layer 20, so that said liquid locally contacts the internal core 30.

For this purpose, the through holes 21 are preferably made by micro-perforations, for example of about 50 μm, spaced from each other by an appropriate distance so that the covering layer 20 maintains sufficient mechanical strength to withstand the pressure forces exerted by the expansion of the lining material of the internal core 30. Such a distance may be at least 500 μm. For example, the micro-perforations are made by laser machining.

Moreover, the covering layer 20 is configured such that the expansion of the lining material substantially causes its deformation. In other words, the covering layer 20 advantageously includes significant elastic features so that the pressure forces generated locally by the expansion of the lining material deform the covering layer 20 in a manner which is perceptible to a user.

More particularly, the covering layer 20 is preferably produced by a laminated complex composed of at least one elastic flexible membrane, for example made of elastomeric material, provided with an elongation at break greater than 600% and a modulus of elasticity less than or equal to 20 MPa measured at 600% elongation, and a stretched polytetrafluoroethylene membrane, for example a membrane known under the trade name "Gore-Tex".

Thus, thanks to these features, it is possible to locally cause an expansion of the lining material opposite each of the through holes 21, over a predefined area according to the distribution of said through holes 21, in a direction opposite the support layer 10, and by extension, in the preferred embodiment of the invention, on the user's wrist. So as to generate on the fashion item 100, for example on the bracelet, reliefs with an aesthetic or informative function, for example representing logos, letters or words, or any other graphic representation.

Indeed, as described above, the support layer 10 and the covering layer 20 are configured so that the expansion of the lining material is carried out only in one or more directions substantially opposite the support layer 10 and oriented towards the covering layer 20. So that the reliefs are visible to a user.

In a first variant embodiment of the invention, the assembly of a fashion item 100 according to the invention is carried out by a first attachment step wherein the support layer 10 and the internal core 30 are connected to each other, then by a second attachment step wherein the covering layer 20 is connected to the assembly obtained in the first attachment step, for example by gluing.

A fashion item 100 assembled according to this variant embodiment is shown in the sectional views of FIGS. 2 and 3.

A fashion item 100 is thus obtained wherein only the covering layer 20 is visible.

This variant embodiment is preferred when the support layer 10 is made of leather.

In another variant embodiment of the invention, the assembly of a fashion item 100 according to the invention is carried out by a first attachment step wherein the covering layer 20 and the internal core 30 are connected to each other, then by a second attachment step wherein the support layer 10 is connected to the assembly obtained in the first attachment step, for example by gluing.

Figure 4:
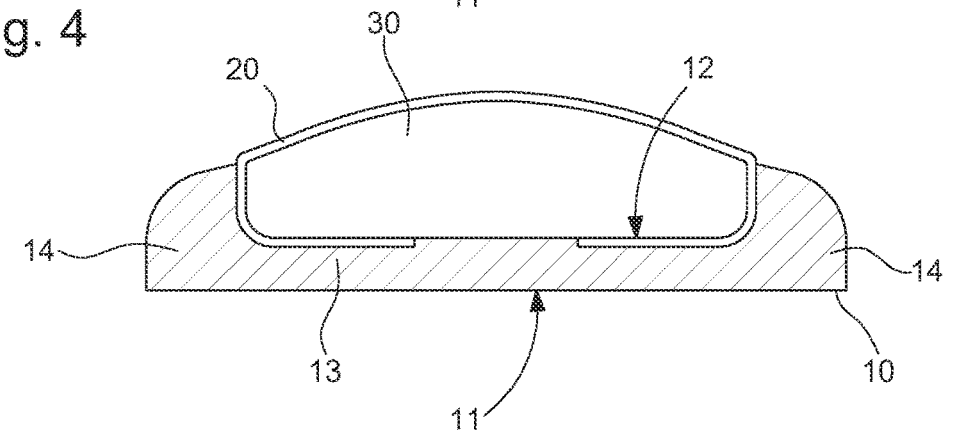
FIG. 4 shows a cross-sectional view of the bracelet of FIG. 1 assembled according to a variant embodiment of the invention.

A fashion item 100 is thus obtained wherein the covering layer 20 and the support layer 10 are visible. A fashion item 100 assembled according to this variant embodiment is shown in the sectional view of FIG. 4.

This variant embodiment is preferred when the support layer 10 is made of an elastomeric material, such as rubber.

The covering layer 20 can also cover all or part of the external face 11 of the support layer 10, thus allowing to protect the latter from external attacks such as friction, humidity, etc.

Preferably, the attachment of the support layer 10 to the internal core 30 or to the assembly formed by the covering layer 20 and the internal core 30, according to the considered variant embodiment described above, is performed by overmoulding or by gluing, so as to ensure that the expansion of the lining material is carried out in the desired directions, that is to say in directions opposite the support layer 10.

Preferably again, the attachment of the covering layer 20 to the internal core 30 or to the assembly formed by the support layer 10 and the internal core 30, according to the considered variant embodiment described above, is performed by embossing or by overmoulding.

The micro-perforations forming the through holes 21 can be made once the production of the bracelet has been completed, that is to say once the assembly of the support layer 10, of the internal core 30 and of the covering layer 20 completed, on the basis of instructions delivered by computer in order to produce a matrix of through holes 21 specific to a predefined graphic representation.

Alternatively, the through holes 21 can be made on the covering layer 20 upstream of the assembly of the support layer 10, the internal core 30 and the covering layer 20.

Thus, by modifying the shape of the matrix of through holes 21 from one fashion item 100 to another, that is to say by modifying the number of through holes 21 and/or their arrangement relative to each other, it is possible to customise the decoration of each bracelet, without changing the manufacturing processes nor the manufacturing means of said fashion items 100.

The invention claimed is:

1. A fashion item including a flexible thin wall with locally and selectively expandable areas, wherein the thin wall comprises:

an internal core made of a lining material which can expand in contact with a liquid, a support layer comprising an external face opposite an internal face on which the internal core is arranged, said support layer being configured so that expansion of the lining material does not substantially cause deformation of the support layer, an impermeable covering layer attached to the support layer so as to tightly enclose the internal core, said impermeable covering layer including one or a plurality of through holes opening onto the internal core and arranged relative to each other so as to form a predefined matrix, said impermeable covering layer being configured such that the expansion of the lining material substantially causes deformation of the impermeable covering layer.

2. The fashion item according to claim 1, wherein the lining material is composed of a hydrophilic thermoplastic elastomer material, super-absorbent fibres, and a compatibilising agent.

3. The fashion item according to claim 2, wherein the lining material is composed of a polyurethane having a hardness approximately equal to 40 shore A, from 5% to 45% by weight of super-absorbent fibres, and a compatibilising agent.

4. The fashion item according to claim 1, wherein the support layer includes a bottom wall interconnecting two side walls, said bottom walls and side walls forming a groove wherein the internal core rests.

5. The fashion item according to claim 1, wherein the support layer is made of a material having an elastic modulus greater than 10 MPa and an elongation at break less than or equal to 180%.

6. The fashion item according to claim 1, wherein the support layer is overmoulded to the internal core.

7. The fashion item according to claim 1, wherein the impermeable covering layer is produced by a laminated complex composed of an elastic flexible membrane having an elongation at break greater than 600% and a modulus of elasticity less than or equal to 20 MPa measured at 600% elongation and a stretched polytetrafluoroethylene membrane.

8. The fashion item according to claim 1, wherein the impermeable covering layer is configured to cover the internal core by overmoulding or by embossing.

9. The fashion item according to claim 1, wherein the through holes are produced by micro-perforations.

10. A bracelet comprising at least one strand including the fashion item according to claim 1.

11. A method for manufacturing a fashion item of material with a locally and selectively expandable area according to claim 1, comprising:

a first attachment step wherein the impermeable covering layer and the internal core are connected to each other to form an assembly, a second attachment step wherein the support layer is connected to the assembly obtained in the first attachment step so that the support layer and the impermeable covering layer tightly enclose the internal core.

12. A method for manufacturing a fashion item of material with a locally and selectively expandable area according to claim 1, comprising:

a first attachment step wherein the support layer and the internal core are connected to each other to form an assembly, a second attachment step wherein the impermeable covering layer is connected to the assembly obtained in the first attachment step so that the support layer and the impermeable covering layer tightly enclose the internal core.

* * * * *